United States Patent [19]

Shindo et al.

[11] Patent Number: 4,829,553

[45] Date of Patent: May 9, 1989

[54] CHIP TYPE COMPONENT

[75] Inventors: Yasuhiro Shindo; Yukio Tsujimoto; Isami Saito, all of Fukui, Japan

[73] Assignee: Matsushita Electric Industrial Co., Ltd., Osaka, Japan

[21] Appl. No.: 145,404

[22] Filed: Jan. 19, 1988

[51] Int. Cl.[4] ..... H01C 1/012

[52] U.S. Cl. ..... 338/309

[58] Field of Search ..... 338/308, 309, 322, 327, 338/325, 332; 29/620, 621; 427/103, 101

[56] References Cited

U.S. PATENT DOCUMENTS 4,073,971 2/1978 Yasujima et al. ..... 427/103
4,358,748 11/1982 Gruner et al. ..... 427/103 X
4,458,294 7/1984 Womack ..... 338/309

FOREIGN PATENT DOCUMENTS 54-26458 2/1979 Japan .
56-21283 5/1981 Japan .
56-21282 5/1981 Japan .
58-10843 2/1983 Japan .
60-192401 12/1985 Japan .

*Primary Examiner*—C. L. Albritton
*Attorney, Agent, or Firm*—Stevens, Davis, Miller & Mosher

[57] ABSTRACT

The invention is directed to the electrode structure of a chip type component, such as a chip resistor, in which a plated film of low melting point metal is used as an outermost coating electrode film on the electrode portion, the layer underlying said plated film of low melting point metal on the electrode portion is formed of a metal material having a higher melting point than that of the plated film and also having good affinity with said plated film, and the electrode material comprising said plated film of low melting point metal is subjected to heat treatment at a temperature higher than the melting point thereof, so that the outermost surface of the electrode portion is coated with a remolten metal film.

6 Claims, 2 Drawing Sheets x 1500 x1500

CHIP TYPE COMPONENT

FIELD OF THE INVENTION

The present invention relates to a chip type component as one of electronic circuit components which can contribute to reduce the weight, thickness and size of electronic equipments.

BACKGROUND OF THE INVENTION

Heretofore, such a chip type component has been structured as shown in FIG. 1. FIG. 1 shows a cross-sectional view of a square plate type chip resistor, in which designated at reference numeral 1 is a glass coating film, 2 an alumina insulating substrate, 3 a resistor substance, 4 a silver electrode film, 5 a nickel film, and 6 a solder or tin film precipitated with the electroplating method. Other relevant techniques are also described in Japanese patent Laid-Open NO. 54-26458 (1979), Utility Model Publications Nos. 56-21282(1981) and 56-21283(1981), Pat. Publication No. 58-10843 (1983), and Utility Model Laid-Open No. 60-192401(1985), etc.

In such conventional structure, the solder or tin film 6 of FIG. 1 is of a plated film having a coarse surface condition as shown in FIG. 2 and, therefore, it has a very large surface area. For this reason, this type film is liable to occlude or adsorb foreign matters thereon. There has thus been a problem of some possibility that the electrode surface may be subjected to chemical changes such as oxidation for a long period of storage, and a soldering failure may be caused in solder-mounting of the chip onto a printed board.

The present invention is intended to solve this problem and has for its object to reduce the surface area of the electrode portion of a chip type component and smooth the surface thereby improving the wetness of solder and enhancing the reliability of soldering after a long period of storage.

SUMMARY OF THE INVENTION

To achieve the above-mentioned object, the present invention resides in an electrode structure of a chip type component, in which a plated film of low melting point metal is used as an outermost coating electrode film on the electrode portion, the layer underlying the plated film of low melting point metal on the electrode portion is formed of a metal material having a higher melting point than and good affinity with the plated film of low melting point metal, and the electrode material comprising the plated film of low melting point metal is subjected to heat treatment at a temperature higher than the melting point thereof, so that the outermost surface of the electrode portion is coated with a remelted metal film.

With the structure disclosed herein, the plated film on the outermost electrode surface is molten due to heating and hence undergoes surface tension in the molten condition, resulting in the minimized surface area. After cooling of the molten plated film, it will be used or stored as a chip type component, Thus, the surface area is considerably reduced and the surface smoothness is also improved compared with the prior art where the plated film is left as it is. As a result, adhesion of foreign matter and adsorption of gases are extremely reduced during a period of storage. Further, because the foreign matters and the gases, etc., which have been adsorped or occluded on the surface or inside the recesses, are discharged during melting, the outermost coating film becomes a clean film free of impurities, which leads to an improvement in the wetness of solder and the reliability of soldering.

DETAILED DESCRIPTION OF THE INVENTION

One embodiment of the present invention will be described below with reference to the accompanying drawings.

Figure 1:
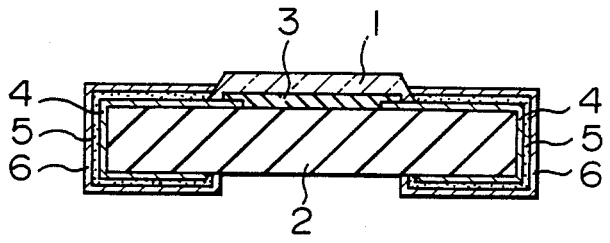
FIG. 1 is a cross-sectional view of a conventional square plate type chip resistor.
Figure 3:
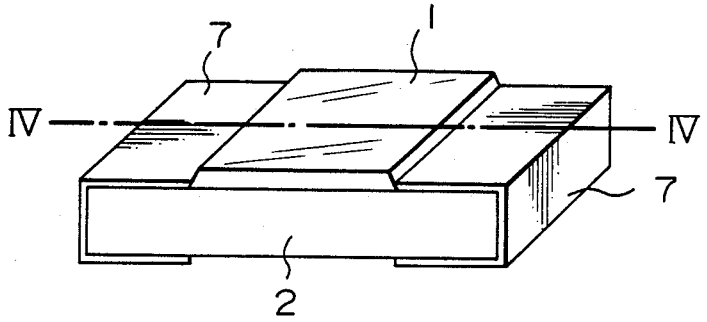
FIG. 3 is a perspective view of a square plate type resistor according to one embodiment of the present invention.
Figure 4:
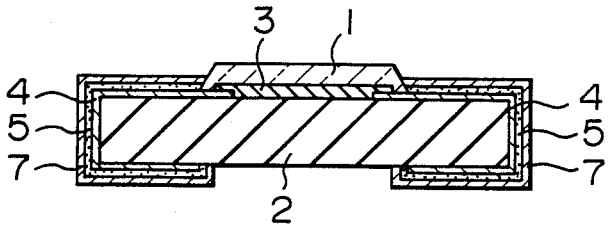
FIG. 4 is a cross-sectional view taken along the line IV—IV in FIG. 3.

FIG. 3 is a perspective view of a square plate type chip resistor according to one embodiment of the present invention, and FIG. 4 is a cross-sectional view taken along the line IV—IV in FIG. 3. In FIGS. 3 and 4, the same parts as those in the conventional chip resistor shown in FIG. 1 are designated by the same reference numerals and the description thereof will be omitted herein.

Referring to FIGS. 3 and 4, designated at reference numeral 7 is a metal film which has been formed by remelting a solder or tin film. Specifically, after a solder or tin film is precipitated on a nickel film 5 with the electroplating method, it is subjected to heat treatment at a temperature higher than the melting point of the material, i.e., solder or tin, for remelting thereof.

Thus, the chip resistor of the present invention is different from the conventional one in that a plated film of low melting point metal is used as an outermost coating electrode film on the electrode portion and is subjected to heat treatment at a temperature higher than the melting point of the electrode film material, to thereby provide a structure where the outermost surface of the electrode portion is coated with the remolten metal film. In this respect, the layer underlying the plated film of low melting point metal (i.e., nickel film 5 in this embodiment) must be formed of a metal material having not only a higher melting point than the plated film of low melting point metal, but also good affinity with the plated film of low melting point metal.

One example of practical means for making the solder or tin film 7 as the remolten metal film stated above will now be described.

By way of trial, a conductive glazed film of 20 μm as a resistor substance 3 was first formed on an alumina insulating substrate 2 with a silver electrode film 4. Then, the nickel film 5 of 5 μm as an electrode and a solder-plated film of 12 μm as an outermost coating film were formed in this order, the solder-plated film being precipitated through the electroplating process and having the composition of tin:lead=60:40 (melting point of 183° .C). After immersing the resulting chip in rosin flux, it was subjected to heat treatment in a heating furnace at 220° C. for a period of 60 seconds. As a consequence, the solder (or tin) film 7 comprising the remolten metal film could be formed on the outermost surface of the electrode portion.

Figure 2:
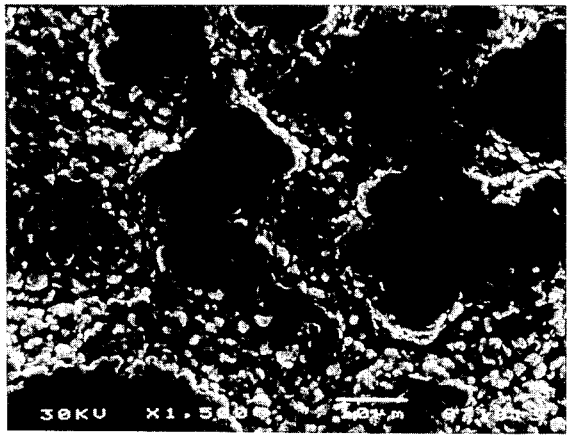
FIG. 2 is an enlarged view of the electrode surface of the chip resistor of FIG. 1.
Figure 5:
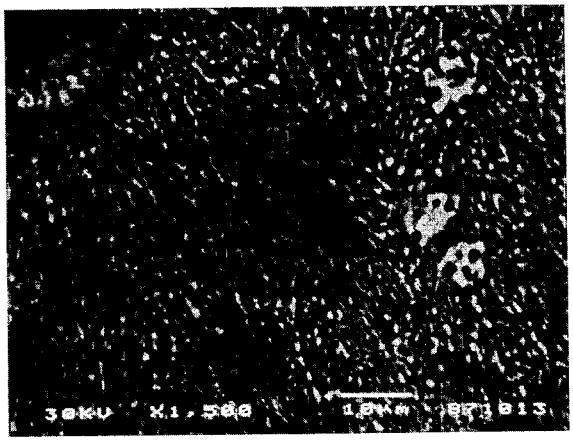
FIG. 5 is an enlarged view of the electrode surface of the chip resistor of FIG. 3.

FIG. 5 shows the surface condition of the chip resistor thus obtained. FIG. 5 represents the electrode surface after heat treatment observed at a magnification of 1500, and FIG. 2 relating to the above-mentioned prior art represents the electrode surface of the chip resistor, which was fabricated under the same conditions (except that the electroplated film was not subjected to heat treatment), observed also at the magnification of 1500. From comparison of these enlarged electrode surfaces shown in FIGS. 2 and 5, it will be found that the conventional chip resistor not subjected to heat treatment has a rough surface with harsh ruggedness, while the present chip resistor subjected to heat treatment has a smoother surface and hence smaller surface area because the solder-plated film has been molten due to heating.

Although the electroplated film has been described in the foregoing embodiment as being used as plated film of low melting point metal which provides the outermost coating film of the electrode portion, the plated film of low melting point metal may be formed with chemical plating in order to obtain a plated film of uniform thickness.

It should also be noted that suitable constituent materials of the electrode portion are not limited to silver, nickel, solder or tin which were used in the foregoing embodiment.

Preferably, the plated film of low melting point metal has a melting point of 100 to 550° C. and a thickness not less than 1 μm. When the melting point is lower than 100° C., the remolten metal film after soldering may happen to melt due to self-heating during use of the chip. When it exceeds 650° C., the resistor substance and the coating film may be broken during heat treatment, and a chip may lose its integrity as an electronic component. Further, when the film thickness is less than 1 μm, it has proven difficult to form a uniform plated film after heat treatment, resulting in that the reliability of soldering will be lowered in mounting and the plated film is more likely to be oxidized during a period of storage. The film thickness of 8 μm–15 μm makes the soldering operation very easy.

A chip type component of the present invention formed as above attains the following effects:

(1) The plated film subjected to heat treatment has a smoother electrode surface than the plated film left as it is, so oxidation of the surface, adhesion-of foreign matter and adsorption of gases are reduced, whereby the reliability of soldering can be ensured even for a long period of storage;

(2) When mounting the chip type component onto a printed board, the smoother electrode surface enables a more slippery contact with other components, resulting in a higher mounting efficiency;

(3) Since the plated film has been once molten, the wetness of solder is improved during the soldering operation and hence soldering failures are reduced; and (4) Owing to the fact that the plated film subjected to heat treatment has a smaller surface area than the plated film left as it is, adsorption of gases is reduced for a period of storage and no bubbles will occur from the solder during the soldering operation, so that the finished solder has a clean surface free of pin holes and the reliability of electronic circuits is enhanced.

We claim:

1. A chip type component having an electrode structure, said electrode structure comprising: an electrode portion, a plated film made of low melting point metal and used as an outermost coating electrode film on the electrode portion, and a layer underlying said plated film on the electrode portion and made of a metal material having a melting point higher than that of said plated film and also having good affinity with said plated film, said electrode structure being heat treated at a temperature higher than the melting point of said plated film so that the outermost surface of the electrode portion is coated with a remolten metal film.

2. A chip type component according to claim 1, wherein said plated film of low melting point metal has a melting point of 100 deg.C. to 550 deg.C.

3. A chip type component according to claim 1, wherein said plated film of low melting point metal has film thickness of not less than 1 μm.

4. A chip type component having an electrode structure, said electrode structure comprising: an electrode portion, a solder-plated film made of low melting point metal and used as an outermost coating electrode film on the electrode portion, and a layer underlying said solder-plated film on the electrode portion and made of a metal material having a melting point higher than that of said plated film and also having good affinity with said solder-plated film, said electrode structure being heat treated at a temperature higher than the melting point of said solder-plated film so that the outermost surface of the electrode portion is coated with a remolten metal film.

5. A chip type component having an electrode structure, said electrode structure comprising: an electrode portion, a solder-plated film made of low melting point metal and used as an outermost coating electrode film on the electrode portion, said-plated film having a film thickness of not less than 1 μm and a melting point of 100 deg.C. to 550 deg.C. and a layer underlying said solder-plated film on the electrode portion and made of a metal material having a melting point higher than that of said solder-plated film and also having good affinity with said solder-plated film, said electrode structure being heat treated at a temperature higher than the melting point of said solder-plated film so that the outermost surface of the electrode portion is coated with a remolten metal film.

6. A chip type component according to claim 5, wherein said plated film of low melting point metal has a film thickness of 8 μm to 15 μm.

* * * * *